US008640321B2

(12) United States Patent
Carter

(10) Patent No.: US 8,640,321 B2
(45) Date of Patent: Feb. 4, 2014

(54) CLINCHING METHOD AND TOOL FOR PERFORMING THE SAME

(75) Inventor: Jon T. Carter, Farmington, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 208 days.

(21) Appl. No.: 13/099,859

(22) Filed: May 3, 2011

(65) Prior Publication Data

US 2012/0279043 A1 Nov. 8, 2012

(51) Int. Cl.
*B21D 39/03* (2006.01)
*B21J 15/14* (2006.01)

(52) U.S. Cl.
USPC ..... 29/521; 29/524.1; 29/243.529; 29/243.5

(58) Field of Classification Search
USPC ..... 29/243.5, 243.529, 283.5, 525.05, 521, 29/524.1, 522.1
See application file for complete search history.

(56) References Cited

U.S. PATENT DOCUMENTS 3,699,626 A * 10/1972 Roth ..... 29/798
5,528,815 A * 6/1996 Webb ..... 29/509
5,581,860 A * 12/1996 Sawdon ..... 29/243.5
5,621,961 A * 4/1997 Schleicher ..... 29/509
5,709,019 A * 1/1998 Sawdon ..... 29/243.5
5,727,302 A * 3/1998 Sawdon ..... 29/436
5,984,563 A * 11/1999 Wu ..... 403/282
6,052,887 A * 4/2000 Dziadosz et al. ..... 29/509
6,612,007 B1 * 9/2003 Wade ..... 29/243.5
6,921,444 B2 7/2005 Joaquin et al.
7,455,746 B2 11/2008 Westall
7,694,399 B2 * 4/2010 Sawdon et al. ..... 29/243.53
8,024,848 B2 9/2011 Carter
8,082,648 B2 * 12/2011 Kozasa et al. ..... 29/505
2010/0084456 A1 4/2010 Carter

FOREIGN PATENT DOCUMENTS

DE 102009036185 2/2011

* cited by examiner

*Primary Examiner* — David Bryant
*Assistant Examiner* — Jason L Vaughan
(74) *Attorney, Agent, or Firm* — Dierker & Associates, P.C.

(57) ABSTRACT

A replaceable deformable insert is disposed in a clinching die cavity having an annular recess adjacent the insert. A first layer is established on a second layer and secured between a retractable punch and the clinching die. The punch is pressed into the first layer to form a depression in the first and second layers. The first and second layers are compressed together between the punch and the clinching die, creating hydrostatic pressure in the first and second layers and the insert. A portion of the insert is extruded to fill the annular recess with insert extrudate, while a portion of the second layer is simultaneously radially extruded into an annular space previously occupied by the insert. A portion of the first layer is simultaneously radially extruded into an annular volume previously occupied by the second layer, thereby forming an interlocking assembly of the first and second layers and insert.

20 Claims, 5 Drawing Sheets

CLINCHING METHOD AND TOOL FOR PERFORMING THE SAME

TECHNICAL FIELD

The present disclosure relates generally to an insert-assisted clinching method and a tool for performing the same.

BACKGROUND

Materials may be secured together using many different methods including, for example, hot clinching and friction stir spot welding. Hot clinching techniques often result in the thermal expansion of the materials, while friction stir spot welding often results in brittle phase formation when joining different materials (e.g., aluminum and magnesium). Other clinching techniques may require the precise alignment of the clinching tool with particular features of the materials to be clinched and/or may result in the splitting or cracking of the clinch button.

SUMMARY

A method of clinching a first layer and a second layer includes disposing at least a portion of a replaceable deformable insert in a clinching die cavity defined in a clinching die. The clinching die cavity has an annular recess adjacent to the insert. The first layer is established on the second layer, and the first and second layers are secured between a retractable punch and the clinching die. The punch is pressed into the first layer, thereby forming a depression in the first layer and the second layer. The first layer and the second layer are compressed together between the punch and the clinching die, thereby creating hydrostatic pressure in the first layer, the second layer, and the insert. A portion of the insert is extruded to substantially fill the annular recess with insert extrudate, while a portion of the second layer is simultaneously radially extruded into an annular space previously occupied by the insert. A portion of the first layer is simultaneously radially extruded into an annular volume previously occupied by the second layer, thereby forming an interlocking assembly of the first layer, the second layer and the insert.

BRIEF DESCRIPTION OF THE DRAWINGS

Features and advantages of the present disclosure will become apparent by reference to the following detailed description and drawings, in which like reference numerals correspond to similar, though perhaps not identical, components. For the sake of brevity, reference numerals or features having a previously described function may or may not be described in connection with other drawings in which they appear.

DETAILED DESCRIPTION

Examples of the method disclosed herein advantageously enable the formation of a lap joint between layers of material. For example, the method may clinch overlapping sheets of material. The materials to be joined may be of similar materials, or may be of different materials. In one example, aluminum alloy sheet metal may be joined to magnesium alloy sheet metal using an example of the disclosed clinching method.

Further, examples of the present disclosure include a clinching method that disposes at least a portion of a replaceable deformable insert in a clinching die cavity defined in a clinching die. It is believed that by providing a radial constraining force on the sheets/layers during the clinching process, cracking of the materials to be joined may be prevented. The insert remains part of the finished clinch joint on the assembly.

Figure 1:
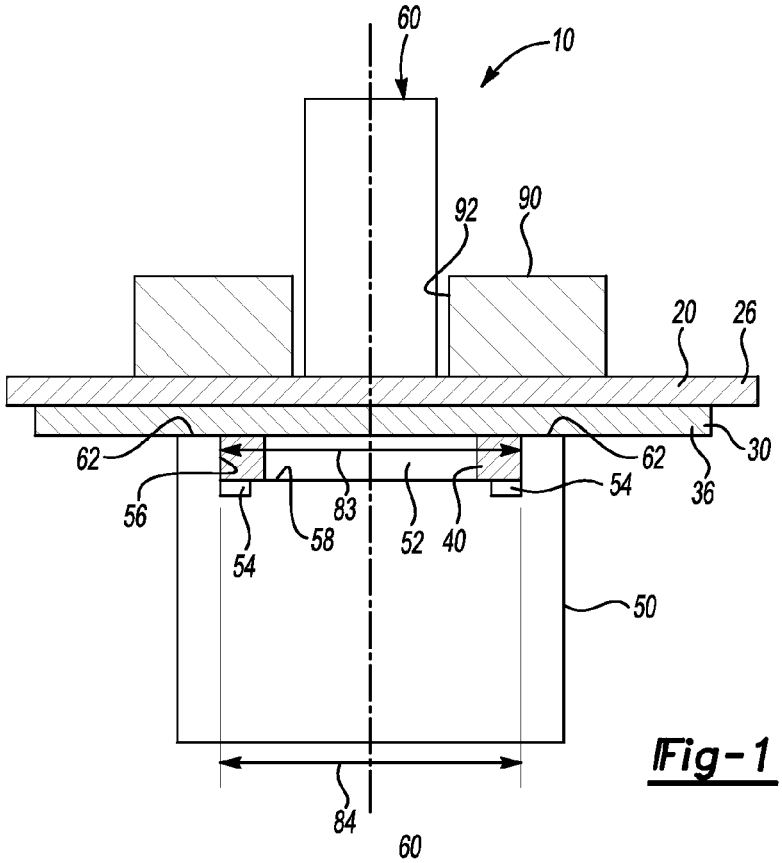
FIG. 1 is a semi-schematic cross-sectional view of an example of a clinching tool securing first and second layers depicting an insert complementarily sized to fit within the die cavity.

Referring now to FIG. 1, in an example of the disclosed clinching method, a first layer 20 may be formed from a first material 26, and a second layer 30 may be formed from a second material 36 different from the first material 26. In other examples, the layers 20, 30 may be formed from the same or substantially the same material. It is to be understood that materials are substantially the same if they include the same base alloy material. The first material 26 may be chosen from aluminum, aluminum alloys, and soft steel (e.g., SAE 1008 and SAE 1010 steel in an annealed state are soft). The second material 36 may be chosen from magnesium, magnesium alloys, and titanium alloys. In further examples, each of the first 26 and second 36 materials may be chosen from the same material.

Figure 4:
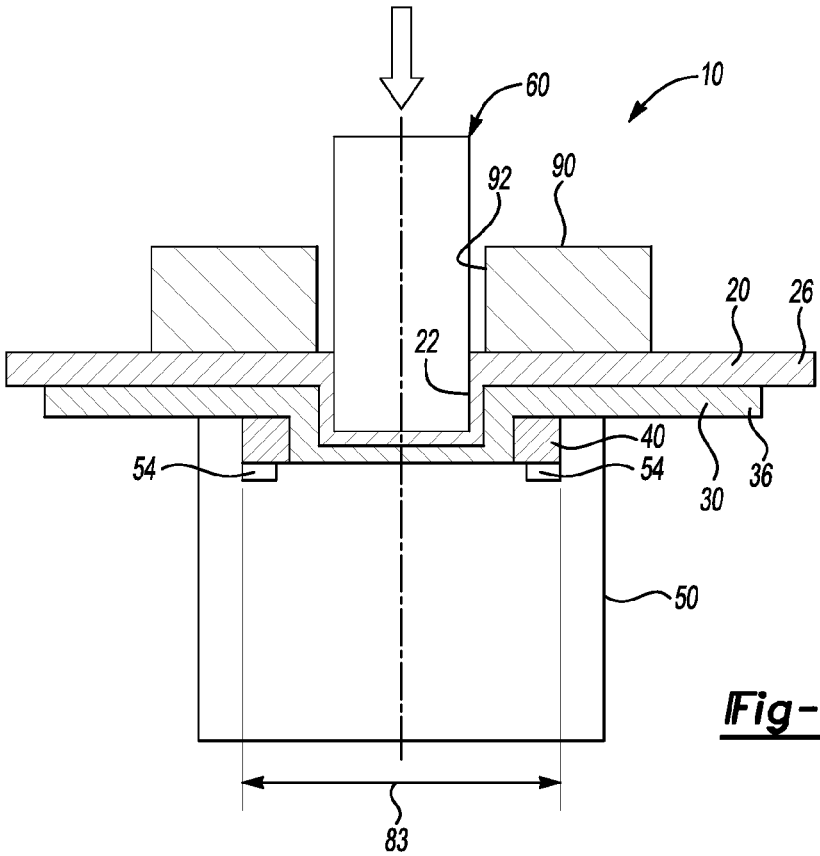
FIG. 4 is a semi-schematic cross-sectional view of an example of a clinching tool pressing into a first layer, thereby forming a depression in the first layer and the second layer.

The method further includes disposing at least a portion of a replaceable deformable insert 40, 40' in a clinching die cavity 52 defined in a clinching die 50. It is to be understood that the insert 40, 40' may be formed from aluminum, aluminum alloys, or soft steel. The clinching die cavity 52 has an annular recess 54 adjacent to the insert 40. The first layer 20 is established on the second layer 30, and the first 20 and second 30 layers are secured between a retractable punch 60 and the clinching die 50. The punch 60 is pressed into the first layer 20, thereby forming a depression 22 (as illustrated in FIG. 4) in the first layer 20 and the second layer 30.

The method further includes compressing the first layer 20 and the second layer 30 together between the punch 60 and the clinching die 50, creating hydrostatic pressure in the first layer 20, the second layer 30, and the insert 40. A portion of the insert 40 is extruded, thereby substantially filling the annular recess 54 with insert extrudate 42 while simultaneously radially extruding a portion of the second layer 30 into an annular space 44 previously occupied by the insert 40. Simultaneously with the insert 40 and second layer 30 simultaneous extrusions, a portion of the first layer 20 is radially extruded into an annular volume 34 previously occupied by the second layer 30. The simultaneous extrusions form an interlocking assembly 70 of the first layer 20, the second layer 30 and the insert 40 (as shown, for example, in FIG. 4). It is to be understood that the term "substantially filling" as used herein means filling at least 50 percent of the volume up to as much as 100 percent of the volume. The method may further include withdrawing the punch 60 from the interlocking assembly 70, and withdrawing the interlocking assembly 70 from the die cavity 52.

Referring again to FIG. 1, an example of a clinching tool 10 is depicted. Clinching tool 10 includes a retractable punch 60, and a clinching die 50. The clinching die 50 includes a die cavity 52 defined in the clinching die 50. The die cavity 52 has an aperture 56 and a reaction surface 58 opposed to the punch 60. The die cavity 52 further includes an annular recess 54 with an outer diameter 84 that is substantially equal to a largest diameter 83 of the die cavity 52. It is to be understood that the term "substantially equal" as used herein means the dimensions are exactly equal, or they differ by less than about 5 percent of the larger diameter. The recess 54 surrounds the reaction surface 58 and extends axially deeper into the clinching die 50 than the reaction surface 58. A support surface 62 circumscribes the aperture 56 and is configured to receive the first layer 20 overlapping the second layer 30. A replaceable deformable insert 40 is configured such that at least a portion of the insert 40 is disposed in the die cavity 52.

Clinching tool 10 may further include a stripper 90 having an aperture 92 defined therein and configured to clamp the first layer 20 overlapping the second layer 30 to the support surface 62 while the punch 60 is advanced toward the die 50, and as the punch 60 is retracted. The die cavity 52 is configured to receive at least a portion of the insert 40.

Figure 2:
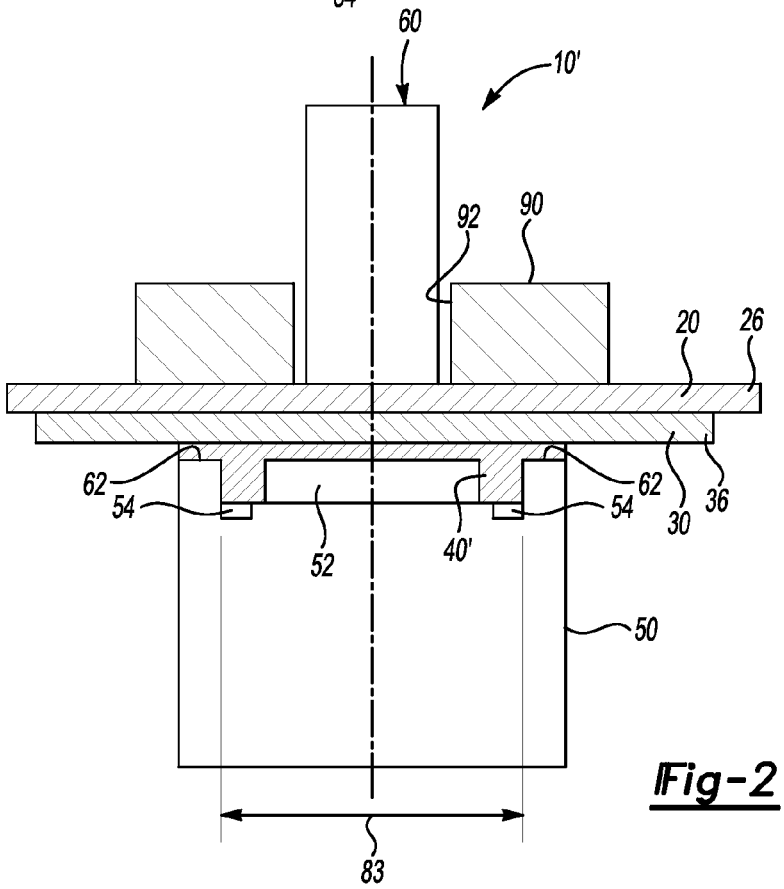
FIG. 2 is semi-schematic cross-sectional view of an example depicting an insert with a flange having an outer diameter greater than a largest diameter of the die cavity and with a cylinder having an open end complementarily sized to nest within the die cavity.

FIG. 1 depicts an example of the replaceable deformable insert 40 that is complementarily shaped and sized to fit entirely within the die cavity 52. As such, the whole replaceable deformable insert 40 is contained within the volume defined by the die cavity 52 and a plane defined by the support surface 62. In contrast, FIG. 2 depicts another example of the replaceable deformable insert 40' where at least a portion of the insert 40' is disposed in the die cavity 52, but the insert 40' is not sized to fit entirely within the die cavity 52. It is to be understood that as disclosed herein, a replaceable deformable insert 40 having at least a portion of the insert 40 disposed in the die cavity 52 may also have a protruding portion (not shown) protruding out of the die cavity 52 beyond the plane defined by the support surface 62.

Figure 3:
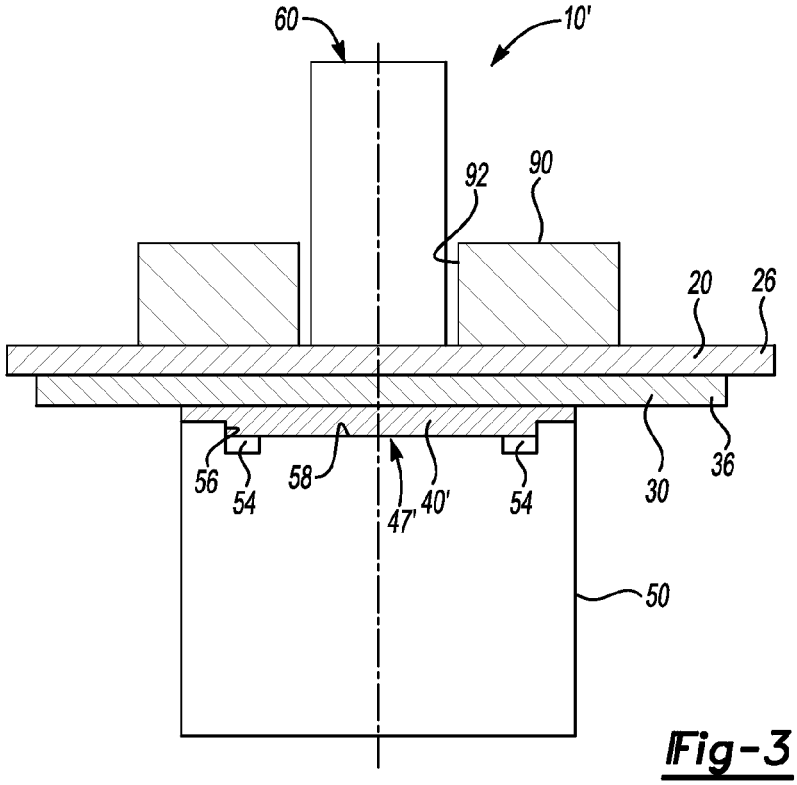
FIG. 3 is semi-schematic cross-sectional view of an example depicting an insert with a flange having an outer diameter greater than a largest diameter of the die cavity and a disk complementarily sized to nest within the die cavity.

FIGS. 2 and 3 depict other examples of the present disclosure that are similar to the example illustrated in FIG. 1, except the inserts 40' as shown have different shapes, e.g., as described further below with regard to FIGS. 8A-8C.

As shown in FIG. 4, the clinching tool 10 is configured to press the punch 60 into the first layer 20, forming a depression 22 in the first layer 20 and the second layer 30. The clinching tool 10 is further configured to compress the first layer 20 and the second layer 30 together between the punch 60 and the clinching die 50.

Figure 5:
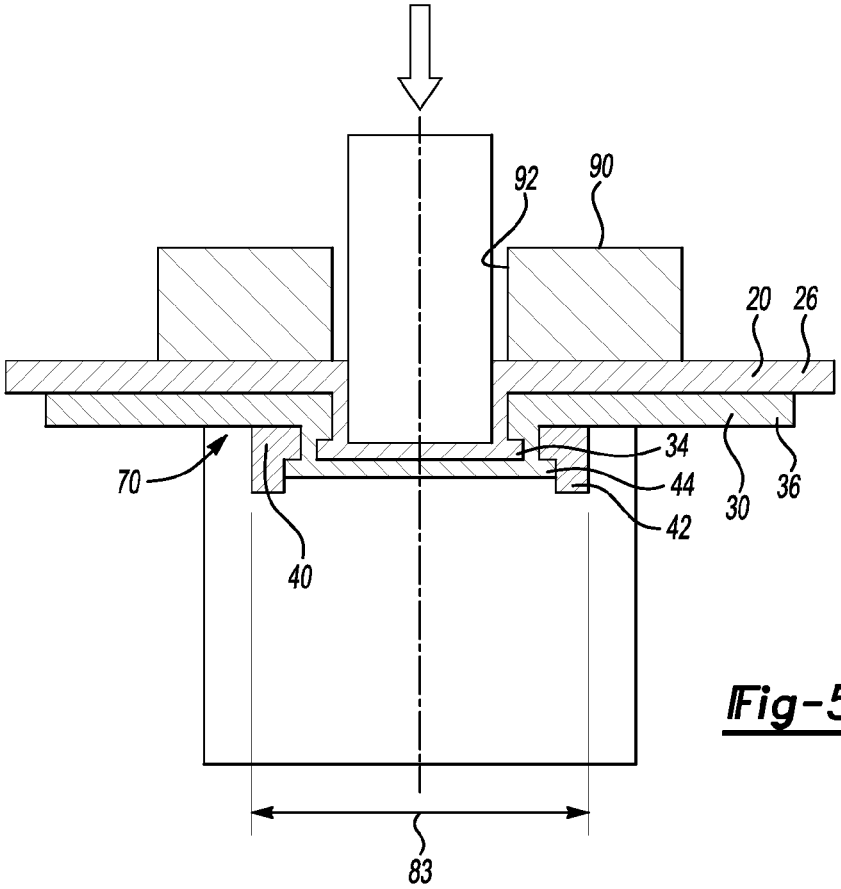
FIG. 5 is a semi-schematic cross-sectional view of the example in FIG. 4, depicting a portion of the insert substantially filling the annular recess with extrudate while simultaneously radially extruding a portion of the second layer into the annular space previously occupied by the insert and simultaneously radially extruding a portion of the first layer into an annular volume previously occupied by the second layer.
Figure 6:
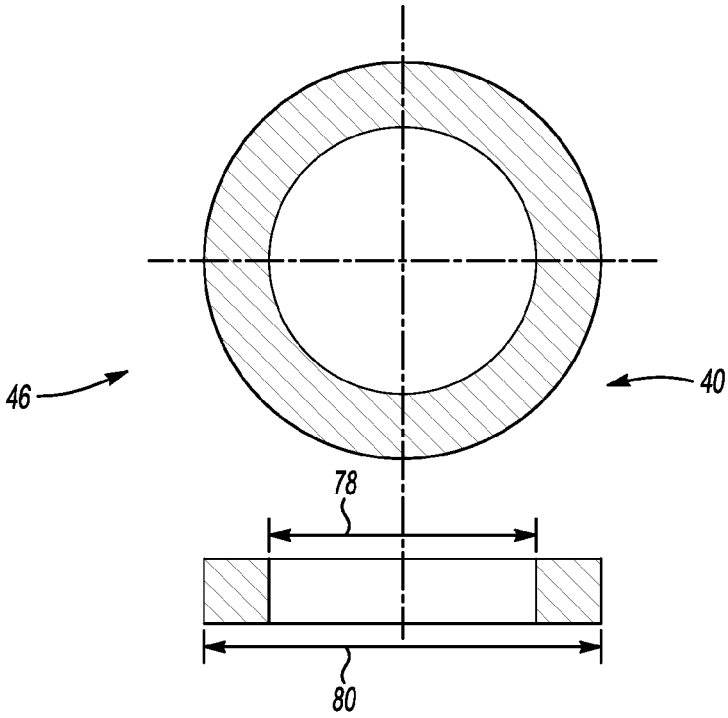
FIG. 6 is a semi-schematic top cross-sectional view and side cross-sectional view of an example of an insert.

Referring now to FIG. 5, compressing the layers 20, 30 together in the clinching tool creates hydrostatic pressure in the first layer 20, the second layer 30, and the insert 40. The hydrostatic pressure causes a portion 45 of the insert 40 to extrude and substantially fill the annular recess 54 with insert extrudate 42, while simultaneously radially causing a portion 32 of the second layer 30 to extrude into an annular space 44 previously occupied by the insert 40. Simultaneously therewith, a portion 24 of the first layer 20 radially extrudes into an annular volume 34 previously occupied by the second layer 30, to form an interlocking assembly 70 of the first layer 20, the second layer 30 and the insert 40.

As illustrated in FIGS. 6 and 7A-7D, examples of the insert 40 may have an annular shape 46 with an inner diameter 78 or a disk shape 47. In other examples, the insert 40 may have a hollow cylindrical shape 48 with an inner diameter 78, an open end 49 and a closed end 43 opposed to the open end.

Figure 7A:
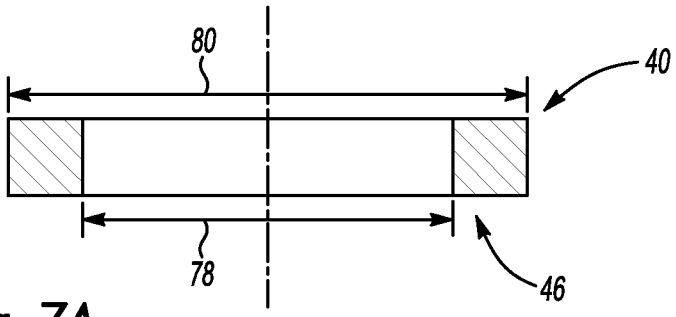
FIGS. 7A-7D are semi-schematic side cross-sectional views depicting examples of inserts complementarily sized to fit within the die cavity.
Figure 7B:
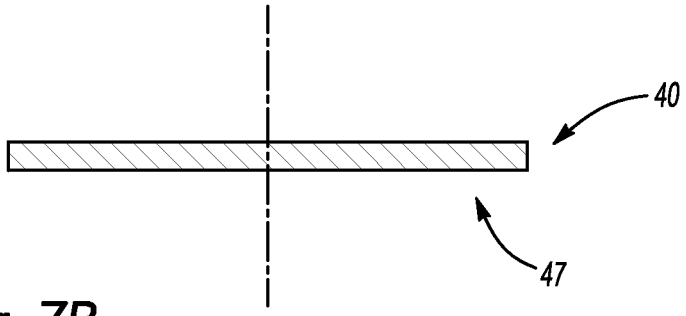
Figure 7C:
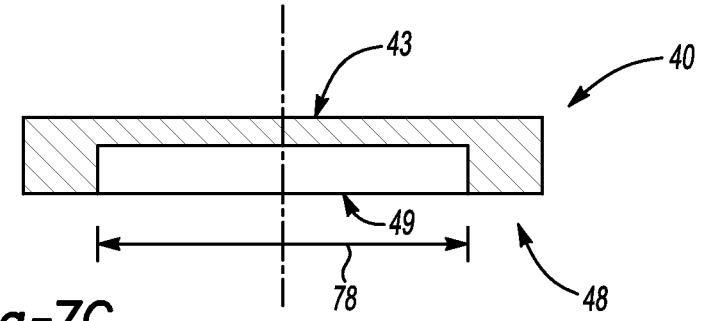
Figure 7D:
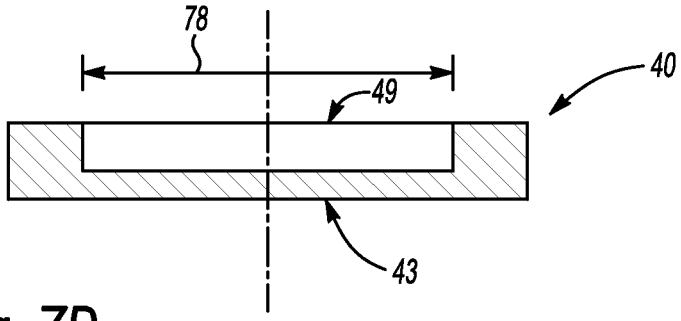

FIGS. 7C and 7D depict similar inserts 40 in different orientations as they would be inserted into the die cavity 52. FIG. 7C depicts insert 40 oriented such that the open end 49 is adjacent to the reaction surface 58, and the closed end 43 is adjacent to the second layer 30. FIG. 7D depicts insert 40 oriented such that the open end 49 is adjacent to the second layer 30, and the closed end 43 is adjacent to the reaction surface 58. The insert 40 may be complementarily sized and shaped to fit entirely within the die cavity 52 (as shown in FIG. 1). For example, an outer diameter 80 of insert 40 depicted in FIGS. 6 and 7A-7D may be smaller than a largest diameter 83 of the die cavity 52 (as shown in FIG. 1).

Figure 8A:
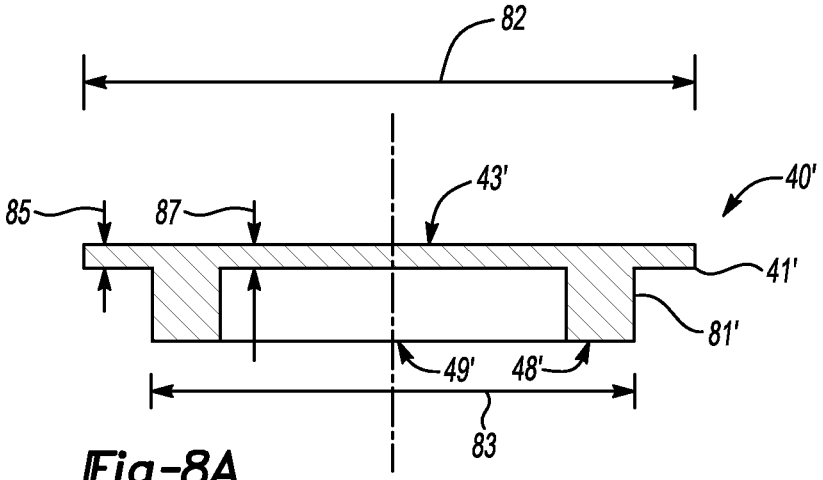
FIGS. 8A-8C are semi-schematic side cross-sectional views depicting examples of inserts having a flange with an outer diameter greater than a largest diameter of the die cavity and portion complementarily sized to nest within the die cavity.
Figure 8B:
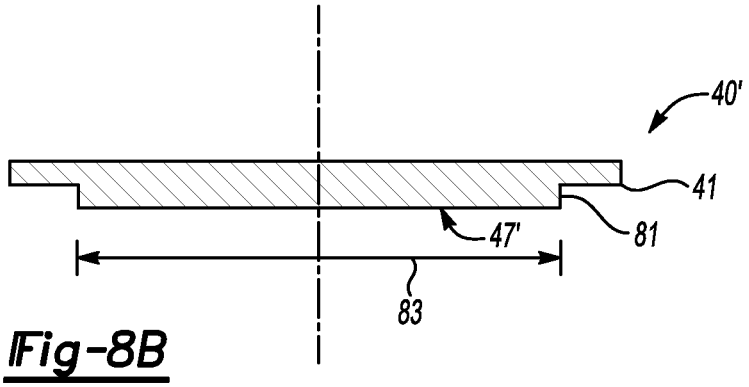

As depicted in FIG. 8B, the insert 40' may be a disk 47' with a flange 41 extending radially outward from an outer edge 81 of the disk 47'. The flange 41, 41', 41" may have an outer diameter 82 greater than a largest diameter 83 of the die cavity 52. As shown in FIG. 8B, the flange 41 may be axially thinner than the disk 47'. The disk 47' may be complementarily sized and shaped to nest within the die cavity 52 (as depicted in FIG. 3).

As shown in FIG. 8A, the insert 40' may be a cylinder 48' with an open end 49' and a closed end 43' opposed to the open end 49', and a flange 41' extending radially outward from an outer edge 81' of the closed end 43'. The flange 41' may have an axial thickness 85 substantially equal to an axial thickness 87 of the closed end 43' of the cylinder 48'. In this instance, substantially equal means the difference between the axial thickness 85 and the axial thickness 87 is less than about 0.005 inch. The flange 41' may have an outer diameter 82 greater than a largest diameter 83 of the die cavity 52, and the open end 49' of the cylinder 48' may be complementarily sized and shaped to nest within the die cavity 52 (as illustrated in FIG. 2).

Figure 8C:
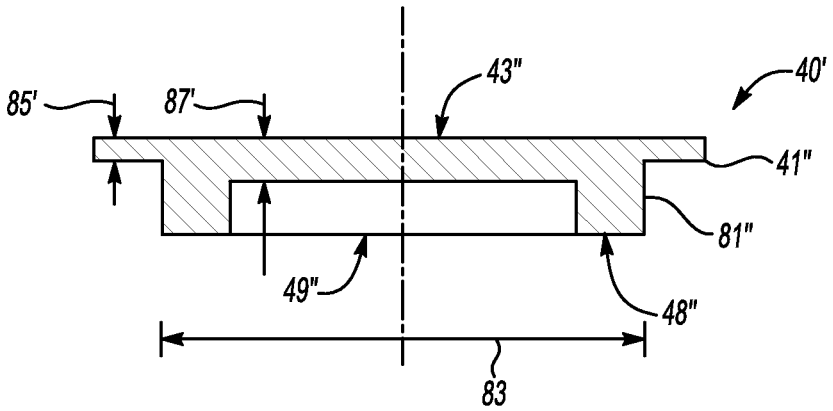

In still another example (as shown in FIG. 8C), the insert 40' may be a hollow cylinder 48" with an open end 49" and a closed end 43" opposed to the open end 49". A flange 41" may extend radially outward from an outer edge 81" of the closed end 43". The flange 41" may have an axial thickness 85' substantially thinner than an axial thickness 87' of the closed end 43" of the cylinder 48". It is to be understood that the term "substantially thinner" as used herein means the axial thickness 85' is at least 0.005 inch thinner than an axial thickness 87' of the closed end 43" of the cylinder 48. The flange 41" may have an outer diameter 82 greater than a largest diameter 83 of the die cavity 52. The open end 49" of the cylinder 48" is complementarily sized and shaped to nest within the die cavity 52 (as illustrated in FIG. 2).

While several examples have been described in detail, it will be apparent to those skilled in the art that the disclosed examples may be modified. Therefore, the foregoing description is to be considered non-limiting.

The invention claimed is:

1. A method of clinching a first layer and a second layer, comprising:

disposing at least a portion of a replaceable deformable insert in a clinching die cavity defined in a clinching die, the clinching die cavity having an aperture, a reaction surface opposed to a retractable punch, an annular recess adjacent to the insert, the annular recess surrounding the reaction surface and extending axially deeper into the clinching die than the reaction surface, the clinching die further including a support surface circumscribing the die cavity aperture, the support surface configured to receive the first layer overlapping the second layer;

establishing the first layer on the second layer;

securing the first and second layers between the punch and the clinching die using a stripper having an aperture defined therein, the stripper configured to clamp the first layer overlapping the second layer to the support surface while the punch is advanced toward the die and as the punch is retracted;

pressing the punch into the first layer, thereby forming a depression in the first layer and the second layer;

compressing the first layer and the second layer together between the punch and the clinching die thereby creating hydrostatic pressure in the first layer, the second layer, and the insert; and extruding a portion of the insert thereby substantially filling the annular recess with insert extrudate while simultaneously radially extruding a portion of the second layer into an annular space previously occupied by the insert and simultaneously radially extruding a portion of the first layer into an annular volume previously occupied by the second layer, thereby forming an interlocking assembly of the first layer, the second layer and the insert.

2. The method as defined in claim 1, further comprising:

withdrawing the punch from the interlocking assembly; and withdrawing the interlocking assembly from the die cavity.

3. The method as defined in claim 1 wherein the insert is formed from aluminum or aluminum alloys.

4. The method as defined in claim 1 wherein the insert has an annular shape or a disk shape, and is complementarily sized to fit entirely within the die cavity.

5. The method as defined in claim 1 wherein the insert has a hollow cylindrical shape with an open end and a closed end opposed to the open end, and wherein the insert is complementarily sized to fit entirely within the die cavity.

6. The method as defined in claim 1 wherein the insert is a disk with a flange extending radially outward from an outer edge of the disk, the flange being axially thinner than the disk, the flange having an outer diameter greater than a largest diameter of the die cavity, and the disk being complementarily sized to nest within the die cavity.

7. The method as defined in claim 1 wherein the insert is a hollow cylinder with an open end and a closed end opposed to the open end, and a flange extending radially outward from an outer edge of the closed end, the flange having an axial thickness substantially equal to an axial thickness of the closed end of the cylinder, the flange having an outer diameter greater than a largest diameter of the die cavity, and wherein the open end of the cylinder is complementarily sized to nest within the die cavity.

8. The method as defined in claim 1 wherein the insert is a hollow cylinder with an open end and a closed end opposed to the open end, and a flange extending radially outward from an outer edge of the closed end, the flange having an axial thickness substantially thinner than an axial thickness of the closed end of the cylinder, the flange having an outer diameter greater than a largest diameter of the die cavity, and wherein the open end of the cylinder is complementarily sized to nest within the die cavity.

9. The method as defined in claim 1 wherein the first layer is formed from a first material and the second layer is formed from a second material different from the first material.

10. The method as defined in claim 9 wherein the first material is chosen from aluminum and aluminum alloys and the second material is chosen from magnesium and magnesium alloys.

11. A clinching tool, comprising:

a retractable punch;

a clinching die including:

a die cavity defined in the clinching die, the die cavity having an aperture, a reaction surface opposed to the punch, an annular recess with an outer diameter substantially equal to a largest diameter of the die cavity, the recess surrounding the reaction surface and extending axially deeper into the clinching die than the reaction surface; and a support surface circumscribing the aperture, the support surface configured to receive a first layer overlapping a second layer;

a replaceable deformable insert configured to have at least a portion of the insert disposed in the die cavity; and a stripper having an aperture defined therein, the stripper configured to clamp the first layer overlapping the second layer to the support surface while the punch is advanced toward the die and as the punch is retracted;

wherein the die cavity is configured to receive at least a portion of the insert and the clinching tool is configured to press the punch into the first layer forming a depression in the first layer and the second layer to compress the first layer and the second layer together between the punch and the clinching die to create hydrostatic pressure in the first layer, the second layer, and the insert, the hydrostatic pressure to cause a portion of the insert to extrude and substantially filling the annular recess with insert extrudate while simultaneously radially causing a portion of the second layer to extrude into an annular space previously occupied by the insert and simultaneously causing a portion of the first layer to radially extrude into an annular volume previously occupied by the second layer to form an interlocking assembly of the first layer, the second layer and the insert.

12. The clinching tool as defined in claim 11 wherein the insert is formed from aluminum or aluminum alloys.

13. The clinching tool as defined in claim 11 wherein the insert has an annular shape and is complementarily sized to fit entirely within the die cavity (52).

14. The clinching tool as defined in claim 11 wherein the insert has a disk shape and is complementarily sized to fit entirely within the die cavity.

15. The clinching tool as defined in claim 11 wherein the insert has a hollow cylindrical shape with an open end and a closed end opposed to the open end, the insert being complementarily sized to fit entirely within the die cavity.

16. The clinching tool as defined in claim 11 wherein the insert has a disk shape with a flange extending radially outward from an outer edge of the disk, the flange axially thinner than the disk, the flange having an outer diameter greater than a largest diameter of the die cavity, and the disk complementarily sized to nest within the die cavity.

17. The clinching tool as defined in claim 11 wherein the insert has a hollow cylindrical shape with an open end and a closed end opposed to the open end, and a flange extending radially outward from an outer edge of the closed end, the flange having an axial thickness substantially equal to an axial thickness of the closed end of the cylinder, the flange having an outer diameter greater than a largest diameter of the die cavity, and the open end of the cylinder complementarily sized to nest within the die cavity.

18. The clinching tool as defined in claim 11 wherein the insert has a hollow cylindrical shape with an open end and a closed end opposed to the open end, and a flange extending radially outward from an outer edge of the closed end, the flange having an axial thickness substantially thinner than an axial thickness of the closed end of the cylinder, the flange having an outer diameter greater than a largest diameter of the die cavity, and the open end of the cylinder complementarily sized to nest within the die cavity.

19. The clinching tool as defined in claim 11 wherein the first layer is formed from a first material, and the second layer is formed from a second material different from the first material.

20. The clinching tool defined in claim 19 wherein the first material is chosen from aluminum and aluminum alloys, and the second material is chosen from magnesium and magnesium alloys.

* * * * *